US007137372B2

(12) United States Patent
Hilpert et al.

(10) Patent No.: US 7,137,372 B2
(45) Date of Patent: Nov. 21, 2006

(54) CYLINDER HEAD COVER

(75) Inventors: Torsten Hilpert, Erdmannhausen (DE); Andreas Weber, Ludwigsburg (DE); Alexander Korn, Gueglingen (DE)

(73) Assignee: Mann & Hummel GmbH, Ludwigsburg (DE)

( * ) Notice: Subject to any disclaimer, the term of this patent is extended or adjusted under 35 U.S.C. 154(b) by 111 days.

(21) Appl. No.: 11/045,076

(22) Filed: Jan. 31, 2005

(65) Prior Publication Data

US 2005/0188937 A1 Sep. 1, 2005

(30) Foreign Application Priority Data

Jan. 30, 2004 (DE) ..... 10 2004 004 753

(51) Int. Cl.
*F01M 9/10* (2006.01)

(52) U.S. Cl. ..... 123/90.38; 123/193.5; 123/198 E

(58) Field of Classification Search ..... 123/90.33, 123/90.37, 90.38, 193.5, 193.3, 195 C, 196 M, 123/198 E, 198 F
See application file for complete search history.

(56) References Cited

U.S. PATENT DOCUMENTS 5,492,086 A * 2/1996 Kuhns ..... 123/90.38
6,725,849 B1 4/2004 Stegmaier et al.

* cited by examiner

*Primary Examiner*—Thomas Denion
*Assistant Examiner*—Ching Chang
(74) *Attorney, Agent, or Firm*—Crowell & Moring LLP

(57) ABSTRACT

A cylinder head cover, particularly for covering a cylinder head of an internal combustion engine, having a plurality of functional elements such as an oil filling connection and at least one oil separation device mounted thereon. The cylinder head cover is formed by a bottom shell and a top shell, with the functional elements each being formed from two segments. One segment is integrally arranged on the bottom shell, and the second segment is integrally arranged on the top shell. The two shells are interconnected by communicating sealing contours. Essential functional parts of the oil separation device are provided on the bottom shell and on the top shell. Preferably the functional elements include a cyclone which separates entrained oil from gases in the cylinder head cover and includes a cup arranged on the bottom shell and an immersion tube arranged on the top shell.

7 Claims, 2 Drawing Sheets

CYLINDER HEAD COVER

BACKGROUND OF THE INVENTION

The present invention relates to a cylinder head cover, in particular for covering the cylinder head of an internal combustion engine, having a plurality of functional parts such as an oil separator mounted thereon.

Cylinder head covers serve to seal off the cylinder head space from the outside of the engine. As a result of operation of the internal combustion engine, blow-by gases from the combustion process and oil droplets from the lubricant system of the engine are present inside the cylinder head. These quantities of gas and liquid present in the cylinder head space are usually passed through separating devices and returned to the intake area and/or the oil circuit. Such separating devices for separating the oil components of the crankcase gas are usually mounted in the immediate vicinity of the cylinder head cover or, ideally, they are integrated into the cylinder head cover.

Stegmaier et al, U.S. Pat. No. 6,725,849 (=DE 101 27 819) describes a cylinder head cover including a preliminary separating device, a cyclone separating device, a fine separating device and a valve device arranged on it in a cascade. The functional elements mentioned above are individually arranged side by side in immediate proximity on the bottom shell of the cylinder head cover. All the functional elements are covered by a housing half-shell. The housing half-shell provides a sealed cover relative to the ambient environment and furthermore does not have any function in the separation process. One disadvantage of this is that a high level of design complexity and a complex manufacturing technology are required to manufacture the individual functional elements, and there is also a high expenditure for materials.

SUMMARY OF THE INVENTION

The object of the present invention is to provide an improved cylinder head cover for the cylinder head of an internal combustion engine.

Another object of the invention is to provide a cylinder head cover which avoids the disadvantages of the prior art.

A further object of the invention is to provide a cylinder head cover which has a plurality of functional element integrated into it, particularly separating devices such as an oil separator.

An additional object is to provide a cylinder head cover which is economical and simple to manufacture from the standpoint of the manufacturing technology.

These and other objects are achieved in accordance with the present invention by providing a cylinder head cover for covering a cylinder head of an internal combustion engine, the cover having a plurality of functional elements mounted thereon including an oil filling connection and at least one oil separating device; the cylinder head cover having a contour formed by a bottom shell and a top shell; the functional elements each being formed from two segments, one of which is integrally arranged on the bottom shell and the other of which is integrally arranged on the top shell, with the respective segments connected by communicating sealing contours; in which the oil separating device comprises at least one cyclone comprising a cup or hollow recess arranged on the bottom shell and an immersion tube arranged on the top shell.

The cylinder head cover according to the invention is particularly suited for covering a cylinder head of an internal combustion engine and for integrating oil separating devices into the cylinder head cover.

The cylinder head cover is comprised of a bottom shell having a peripheral sealing flange arranged on its bottom side to facilitate connecting the cylinder head cover to the cylinder head. The bottom shell is curved upward, enclosing the entire cylinder head in the form of a cover. In addition, functional contours are mounted on the bottom shell, each forming a segment for a functional element. In particular, oil separating devices are provided as the respective functional elements. The functional contours on the bottom shell are in turn enclosed by a sealing contour.

One segment forms a functional contour for a cyclone separator, this segment forming a cup of a cyclone. This cup is integrated into the bottom shell in such a way that a lower wall closure of the cup protrudes into the cylinder head space and an upper wall closure of the cup protrudes into the bottom side of the bottom shell. A tangential recess is provided on an opened side of the cup wall. The lower side of the cup tapers conically to a small connecting hole which establishes a connecting cross section with the cylinder head space. Thus the cup of the cyclone is integrated into the bottom shell of the cylinder head cover as a segment thereof.

A top shell of the cylinder head cover in turn covers the functional contour of the bottom shell and seals it with communicating sealing contours. In addition, an immersion tube which extends through the top shell is provided in the top shell, its position being aligned with the cup. In the installed state, the immersion tube protrudes into the conical area of the cup. The immersion tube in this case penetrates through a wall of the top shell and has a suitable connection formed on the outside for connection to a volume flow. This volume flow is usually achieved due to the differential pressure prevailing in the intake manifold.

To optimally utilize the installation space in the cylinder head, several cyclones may be arranged side by side and then be connected in parallel or in series or optionally turned off or on by actuators depending on the volume flow. The gases laden with oil vapor from the cylinder head space are aspirated through a tangential recess on the top of the cup, and a rotating spiral motion is induced due to the shape of the cup. These gases are exhausted through the top shell from the mouth end of the immersion tube and are usually returned to the intake tract of the internal combustion engine.

The oil particles present in the gas are thrown against the wall of the cup as a result of the rotation about the immersion tube and then flow out through the connecting hole into the cylinder head space due to gravity. The cyclone separator may also be combined with other fine separators or coarse separators, which may also be integrated into the cylinder head cover, such as a labyrinth separator.

The cylinder head cover according to the invention makes it possible to reduce the number of additional components in an advantageous manner. Individual parts which would otherwise have to be manufactured and assembled separately are already integrated into the top shell and/or bottom shell and fulfill their function after assembly. The individual parts may also be clipped, glued or welded to the respective shells. The shells are preferably manufactured in one piece. Any additional functional elements required such as springs, membranes, valves or shutter elements can be assembled even before the shells are joined to each other. The integration of the functional segments yields a structural clearance which makes it possible to reduce the required available space.

One advantageous embodiment of this invention is obtained due to the choice of injection molded synthetic resin material as the material for both shell parts. Due to the use of injection molding technology, the joint face of the molds can be arranged in the area of the cyclone, thus permitting a mold design that is free of undercuts. The additional mold complexity can be minimized with this design to a lateral slide in each case, this slide forming the central pipe on the top shell and the cup shape of the cyclone on the bottom shell. In addition to the variable design possibility obtained through the choice of the injection molded synthetic resin material, a desirable weight advantage can also be achieved through the use of synthetic resin material.

Another advantageous embodiment of this invention is obtained when using synthetic resin material as a material inasmuch as the two shells are welded together by corresponding sealing surfaces. In addition to a glue, screw or catch connection, a weld yields the possibility of eliminating additional connecting parts and establishing a permanently tight and reliable connection. Additional elements such as gaskets and connecting elements may be omitted in the welding operation, thus also simplifying assembly and yielding a space advantage in the area of the connection.

Yet another advantageous embodiment of the inventive idea is obtained by forming a reservoir in the bottom shell, which reservoir can be sealed by the top shell and may form an additional functional part. This reservoir may function as a pressure equalizing container, for example, which is necessary for optimum operation of a vacuum-controlled actuator, for example. In this case, the reservoir is connected through a flow cross section to a vacuum line system by a connection. It is advantageous here that a reservoir constructed in this manner performs an additional function which can be carried out independently of the function of the cylinder head cover. Due to the spatial integration of the reservoir into the cylinder head cover, the available space can be utilized and installation room elsewhere is saved.

A further especially advantageous embodiment of this invention is obtained by arranging a reservoir which communicates through a connecting hole with a cyclone unit. The bottom of this reservoir is geodetically lower than the connecting hole to the cyclone separator. Ideally, a return and then non-return valve is arranged at a low point in the reservoir, sealing off the reservoir above due to the vacuum generated when the engine is operating. With this arrangement, the oil that is separated collects in the reservoir when the engine is in operation and flows through the connecting hole and into the reservoir; when the engine is shut down. The oil flows into the cylinder head space when the return valve is opened. The oil is prevented from flowing back through the connecting hole into the cyclone space due to the fact that the reservoir is closed when the engine is in operation. Thus all the separated gas that flows through the cyclone is drawn in through the tangential recess, thus increasing the efficiency of the cyclone. In this way, the functional parts which regulate the flow of separated oil are advantageously also integrated into the cylinder head cover.

It is also advantageous to provide a pressure regulating valve in connection with the cyclone separator. It is suggested in this case that the base body of the pressure regulating valve be arranged in the direct extension to the immersion tube of the cyclone and the other functional elements of the pressure regulating valve, e.g., springs, diaphragms, shutter valve and cover, advantageously be mounted separately on the pressure regulating valve. One possibility of connecting the pressure regulating valve to the immersion tube is also made possible through a plug connection, whereby in this embodiment a sleeve must be provided on the top shell or on the body of the pressure regulating valve. The oil-laden combustion gases from the cylinder head space are thus exposed to tangential oncoming flow due to the cup of the cyclone separator, caused to rotate and then continue to rotate in a spiral toward the lower end of the immersion tube, which sucks them up. In their remaining course, these pre-cleaned gases flow through the pressure regulating valve, through the suction connection, and back to the intake tract of the internal combustion engine.

When there is a direct connection between the housing of the pressure regulating valve and the top shell, further integration of functional elements into a single component is advantageous, so that handling and logistics can be reduced in the area of fabrication and assembly. In addition, the number of mounting and connecting parts required between the pressure regulating valve and the cylinder head cover can be reduced. The direct cross-sectional extension which leads from the immersion tube to the pressure regulating valve thus reduces possible flow resistance so that the immersion tube can be designed to be relatively thin.

These and other features of preferred embodiments of the invention, in addition to being set forth in the claims, are also disclosed in the specification and/or the drawings, and the individual features each may be implemented in embodiments of the invention either alone or in the form of subcombinations of two or more features and can be applied to other fields of use and may constitute advantageous, separately protectable constructions for which protection is also claimed.

BRIEF DESCRIPTION OF THE DRAWINGS

The invention will be explained in greater detail hereinafter with reference to an illustrative embodiment shown in the accompanying drawings, in which.

DETAILED DESCRIPTION OF PREFERRED EMBODIMENTS

Figure 1:
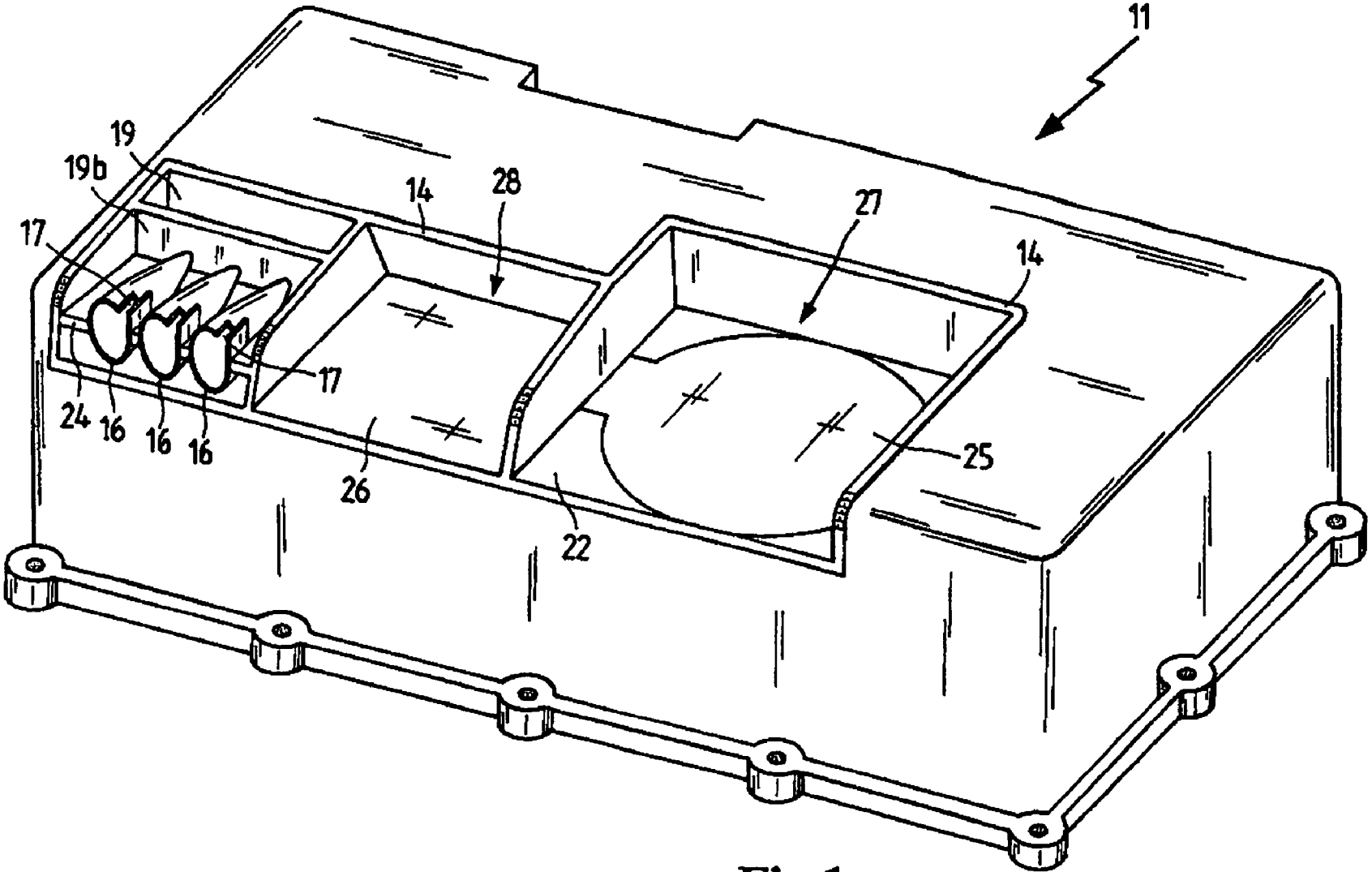
FIG. 1 is a perspective view of the bottom shell of a cylinder head cover according to the invention.

FIG. 1 shows the bottom shell 11 of a cylinder head cover with a segment of different functional elements molded into it. In the assembled state with a top shell (not shown), three cups 16 arranged side by side form the functional element of the cyclone separator. The outside of the cups 16 has a free connection to the cylinder headspace 22. In the installed state, the ends of the cups 16 are closed off by the top shell 12 (FIG. 2) so that the crankcase gases can be exposed to oncoming flow only through the tangential recesses 17. The cups 16 taper in a conical area to a partition 19*b* of a directly adjacent reservoir 19, and they communicate with the reservoir 19 through a connecting hole 18 shown in FIG. 2.

In the installed state, the functional element of the cyclone is closed by the sealing contour 14, which communicates with the sealing contour of the top shell (not shown), so that the function of the cyclone is ensured. In the illustrative embodiment shown here, the sealing contour 14 extends around all the individual functional elements. However, it is also possible to separate the individual functional elements from one another in space and to close them off with multiple top shells.

The three cups 16 arranged side by side are connected to the bottom shell by a connecting web 24. However, it is also possible to arrange the cups 16 so that they are directly adjacent one wall of the bottom shell 11. The upper side of the cups 16 on which the tangential recesses 17 are also situated and the upper side of the connecting web 24 thus form the upper joint face of the mold.

Figure 2:
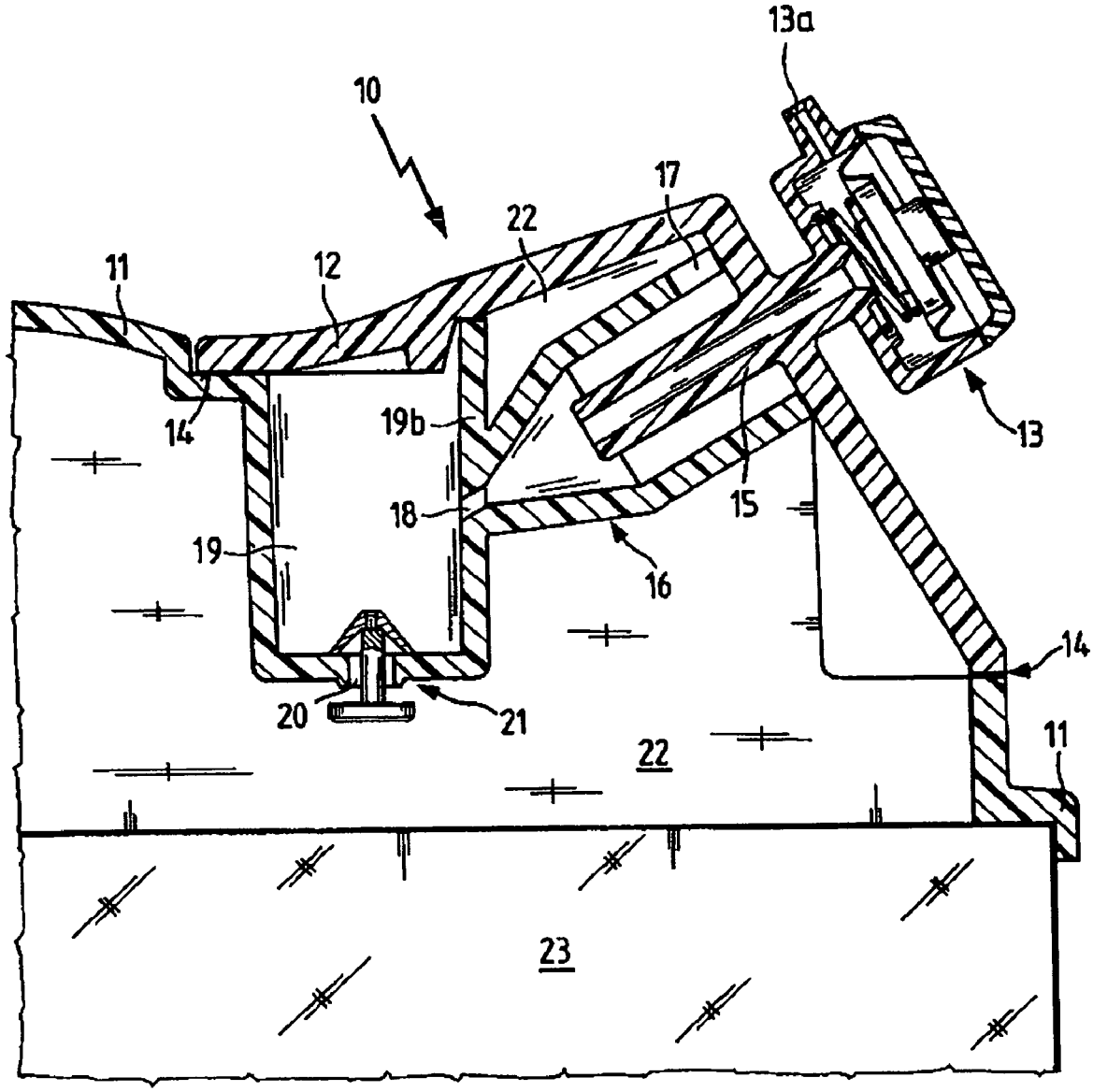
FIG. 2 is a full section through a completed cylinder head cover at the plane of the cyclone combined with the pressure regulating valve. Components corresponding to those shown in FIG. 1 are identified by like reference numerals.

In the installed state, a pressure container 28 forms an additional functional element, with the function of the pressure container 28 being ensured after assembly of the top shell 12 (FIG. 2). The pressure container 28 is sealed in relation to the lower side, i.e., the cylinder head space 22, by an integrally molded base plate 26.

Another segment of the oil filling connection 27 as a functional element is formed in the installed state with the top shell 12 (FIG. 2). This segment is also sealed by the sealing contour 14 in the installed state. Toward the lower side of the cylinder headspace 22, the oil filling connection 27 as a functional element is bordered by the shielding plate 25. The shielding plate 25 serves only as a splashguard for the oil in the cylinder head. It is important to ensure that oil cannot flow out at the edges of the shielding plate 25.

FIG. 2 shows the cyclone separator as a functional element, in which the two segments of the cyclone separator, i.e., the top shell 12 and the bottom shell 11, are joined together and sealed. In the cylinder head cover 10, a detail of which is shown here, the bottom shell 11 is mounted on the cylinder head 23 by connecting elements (not shown). The top shell 12 is thus connected to the sealing contours 14 as well as the end faces of the cup 16 and sealed.

The pressure-regulating valve 13 is integrated into the top shell 12 in the direct extension of the immersion tube 15 and serves to keep the vacuum in the cylinder head space 22 constant. The immersion tube 15 opens in the conical region of the cup 16. The tangential recess 17 is arranged on the top side in the illustrative embodiment shown here, but it may also be arranged at the side or at the bottom. The angle of inclination of the cups 16 must be selected so that there is also a slightly sloped inclination in the conical area with respect to the reservoir 19. The reservoir 19 is arranged directly adjacent to the cup 16 and communicates through a connecting hole 18 through the partition 19*b* with the cup 16. The reservoir 19 is also sealed at the end faces of its side walls by the peripheral sealing contour 14.

A return hole 20 is provided at the lowest point in the reservoir 19. Return hole 20 is closed by a return valve 21 when the internal combustion engine is in operation and it opens when the engine stops. The functional unit of the resulting cyclone separator may be arranged individually, or multiple cyclone separators may be arranged in parallel. The arrangement of a reservoir 19 is not absolutely necessary because outflow of the fluid separated through the connecting hole 18 directly into the cylinder head space 22 is also conceivable.

When the combustion engine is operating, the crankcase gases are drawn in through an intake connection 13*a* which communicates with the intake tract of the internal combustion engine. Therefore the crankcase gases flow out of the cylinder head space 22 through the tangential recess 17 and into the cup 16 and are thus made to rotate about the immersion tube 15 so that the oil particles are deposited on the walls of the cup 16 and can flow out into the reservoir 19 through the connecting hole 18 due to the force of gravity and following the direction of flow. These pre-cleaned gases are returned to the intake tract through the pressure-regulating valve 13 via the suction connection 13*a*. Liquid which is separated collects in the reservoir 19, whereby the return valve 21 closes the return 20 in the operating state and opens the return valve of the reservoir again at partial load and when the engine is idling or turned off. When the return valve 21 is opened, the oil that has been separated flows into the cylinder head space 22 and thus enters the oil circuit.

The foregoing description and examples have been set forth merely to illustrate the invention and are not intended to be limiting. Since modifications of the described embodiments incorporating the spirit and substance of the invention may occur to persons skilled in the art, the invention should be construed broadly to include all variations within the scope of the appended claims and equivalents thereof.

What is claimed is:

1. A cylinder head cover for covering a cylinder head of an internal combustion engine, said cover having a plurality of functional elements mounted thereon including an oil filling connection and at least one oil separating device; said cylinder head cover having a contour formed by a bottom shell and a top shell; said functional elements each being formed from two segments, one of which is integrally arranged on the bottom shell and the other of which is integrally arranged on the top shell, with the respective segments connected by communicating sealing contours; wherein said oil separating device comprises at least one cyclone comprising a cup arranged on the bottom shell and an immersion tube arranged on the top shell.

2. A cylinder head cover according to claim 1, wherein the two shells of the cylinder head cover are made of injection molded synthetic resin material.

3. A cylinder head cover according to claim 1, wherein the top shell and the bottom shell are joined together and sealed by a welding method so that the function of the functional elements is ensured by this connection.

4. A cylinder head cover according to claim 1, wherein at least one of said functional elements is a reservoir.

5. A cylinder head cover according to claim 4, wherein the reservoir is connected by a connecting hole to an oil drain of the cyclone, and a valve is arranged at the lowest point of the reservoir; said valve closing off the reservoir when the internal combustion engine is in operation.

6. A cylinder head cover according to claim 1, wherein at least one of said functional elements is a vacuum container.

7. A cylinder head cover according to claim 1, wherein at least one of the top shell and the bottom shell is connected to a pressure-regulating valve.

* * * * *